US005736014A

United States Patent [19]

Drese et al.

[11] Patent Number: 5,736,014

[45] Date of Patent: Apr. 7, 1998

[54] DEVICE FOR THE SELECTIVE TREATMENT OF THE SURFACE OF WORKPIECES BY FLOODING THE WORKPIECES WITH A TREATMENT LIQUID

[75] Inventors: Hermann A. Drese, Pforzheim; Werner Emde, Weissach-Flacht; Klaus Knorr, Leonberg, all of Germany

[73] Assignee: Stohrer-Doduco GmbH & Co., Rutesheim, Germany

[21] Appl. No.: 624,575

[22] PCT Filed: Oct. 5, 1994

[86] PCT No.: PCT/EP94/03294

§ 371 Date: Apr. 1, 1996

§ 102(e) Date: Apr. 1, 1996

[87] PCT Pub. No.: WO95/09939

PCT Pub. Date: Apr. 13, 1995

[30] Foreign Application Priority Data

Oct. 6, 1993 [DE] Germany ..... 43 34 106.3

[51] Int. Cl.[6] ..... C25D 17/02; B05C 3/00

[52] U.S. Cl. ..... 204/198; 204/225; 204/275; 204/297 R; 118/428; 118/429

[58] Field of Search ..... 118/423, 428, 118/429; 204/198, 225, 224 R, 224 M, 275, 297 R

[56] References Cited

U.S. PATENT DOCUMENTS

| | | | |
|---|---|---|---|
| 3,746,632 | 7/1973 | Kühdorf et al. | 204/275 X |
| 4,093,530 | 6/1978 | Isaakovich et al. | 204/275 X |
| 5,224,994 | 7/1993 | Daly | 118/423 X |
| 5,552,026 | 9/1996 | Ikegaya et al. | 204/275 X |

FOREIGN PATENT DOCUMENTS

| | | |
|---|---|---|
| 2681336 | 3/1993 | France . |
| 1771933 | 6/1976 | Germany . |
| 3142739 | 10/1983 | Germany . |
| 3742602 | 6/1989 | Germany . |
| 4020173 | 1/1991 | Germany . |
| 3937763 | 1/1993 | Germany . |

*Primary Examiner*—Donald R. Valentine
*Attorney, Agent, or Firm*—Dvorak & Orum

[57] ABSTRACT

The device for the selective treatment of the surface of workpieces by flooding the workpieces with a treatment liquid comprises a bath (1), interchangeable holders (10) in the bath for the workpieces, at least one pip (15-21) leading into the bath (1) taking the liquid to the holders (10) and at least one outlet pipe (26) for the liquid leaving the bath (1). The holders (10) are fitted on an extractor (7) and in the side walls of the bath (10) there is a closable access (31) through which the extractor (7) can be removed.

20 Claims, 6 Drawing Sheets

Figure 1:
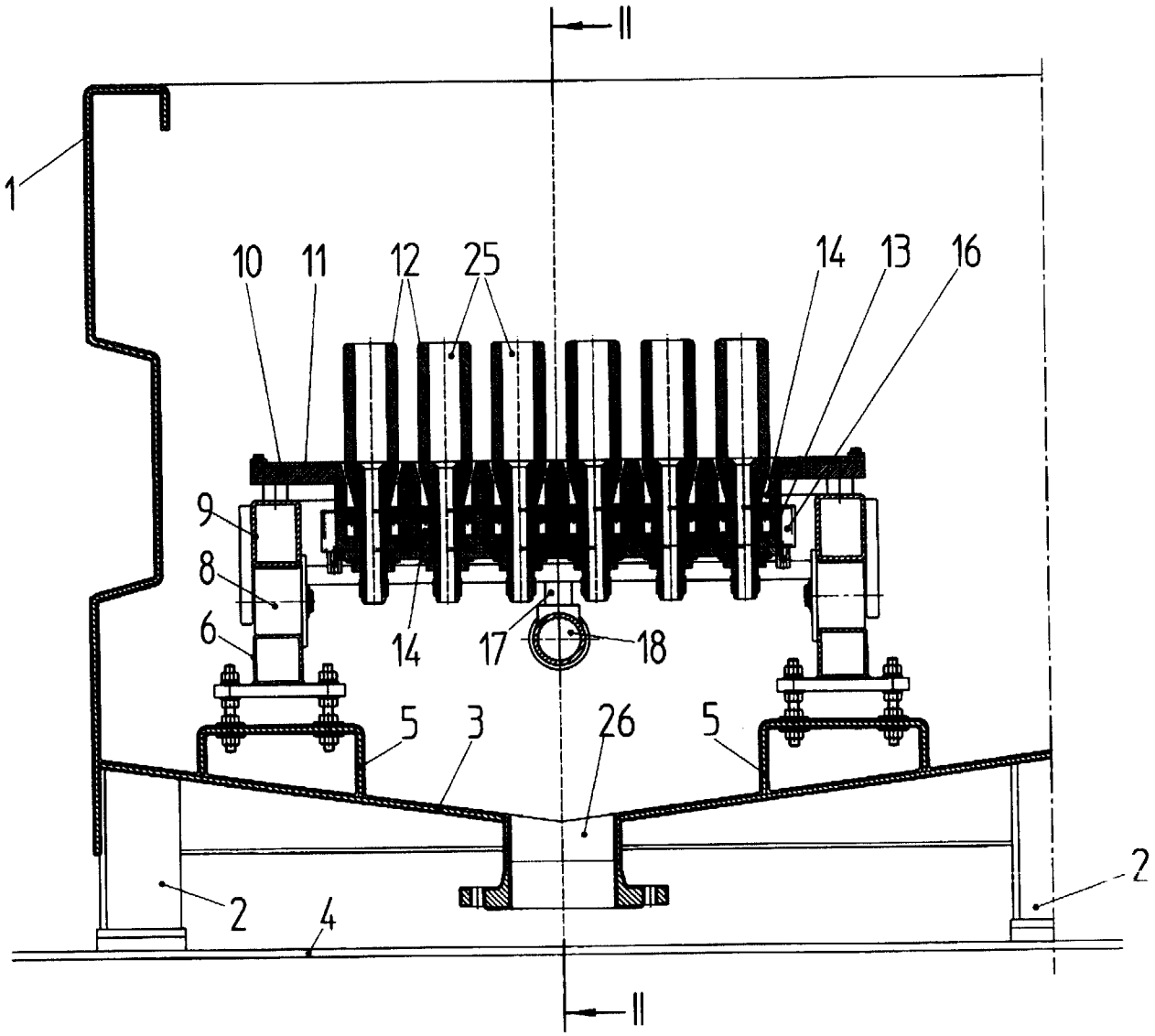

DEVICE FOR THE SELECTIVE TREATMENT OF THE SURFACE OF WORKPIECES BY FLOODING THE WORKPIECES WITH A TREATMENT LIQUID

DESCRIPTION

The invention starts out from a device with characteristics given in the preamble of claim 1. Such a device is known for the nickel-plating of cylinder running surfaces of internal combustion engines. For this purpose the internal combustion engines are placed on a treatment table with cylinder openings facing down, whereby a hollow electrode projects from the treatment table into each cylinder. With the cylinders closed off by the treatment table, a treatment liquid, that is to say a nickel electrolyte, is piped from below into the cylinders, that is to say into the annulus between electrode and cylinder wall, rises up in the annulus and leaves by way of the hollow electrode (DE-PS 37 42 602).

Shape and composition of the treatment tables and the mounted, upward projecting electrodes depend on the structural shape of the engine to be treated. If cylinder running surfaces of different types of engines are to be treated in the installation, treatment tables and electrodes need to be exchanged. For this purpose a mechanic must climb into the tub and carry out the work necessary for the exchange under very cramped conditions, and replacement parts must be lifted in and out of the tub which is also very tiresome, since replacement pans are heavy and unwieldy, and built-in structures get in the way. Retooling the device for a different type of engine is therefore time consuming and necessitates a shut-down for a lengthy period of time. The shut-down of the device results in a shut-down of the total installation, consisting of preparatory treatment stations, coating stations and aftertreatment stations, since the device, according to the invention, is an integral part of the installation.

The object of the invention on hand is to show how the retooling can be facilitated and how the installation downtime can be minimized.

The object is solved by a device with characteristics given in claim 1. Advantageous further developments of the invention are the subject of the dependent claims.

By the fact that the treatment tables are mounted on a pull-out module which can be extracted from the side of the tub, it is no longer necessary that a mechanic climbs into the tub when retooling the device for another type of engine. Rather, the treatment tables required for another type of engine can be assembled outside the tub, for example in a work shop, on a separate pull-out module and readied for installation, so that the remaining work to be done at the tub simply consists of extracting the pull-out module from the tub, setting it aside, inserting the prepared pull-out module into the tub and again closing the lateral access to the tub.

In this manner the time period during which the device has to be shut down for retooling is exceedingly short, and can even be virtually nil under the most favorable circumstances, because the work to be carried out at the tub can be reduced to a minimum and is independent of the pull-out module, and therefore an interruption of the production is not required. All other assembly and maintenance work associated with retooling can be carried out outside the tub without time pressure and therefore with greater care, whereby there is the additional advantage that assembly and maintenance work is not hampered by cramped work space and by an environment which is contaminated by disagreeable chemicals. The invention proves its worth not only when retooling the device to suit another type of engine, but also in case treatment tables, electrodes or other associated parts in the tub become damaged and a repair becomes necessary, and therefore the device has to be taken out of service. In this case a spare pull-out module of equal type can be kept ready, so that the exchange can be done in a flash, the damage on the replaced pull-out module can be diagnosed and repaired without time pressure and the repaired pull-out module can be kept as a spare.

Extracting the pull-out module laterally has the additional advantage that a special hoist above the tub is not needed; rather, the pull-out module can be extracted on rails by remaining at the elevation it occupied in the tub, picked up outside the tub by a suitably adapted carriage and transported away.

The invention is not only applicable to installations where the tub contains one pull-out module only. Rather, the tub can contain a multitude of pull-out modules, side-by-side or back-to-back, which can be extracted by way of a corresponding number of closeable accesses.

Emphasized is the possibility of two pull-out modules arranged back-to-back and supported such that they may be extracted on opposite sides of the tub.

The access through which a pull-out module can be extracted from the tub has to be closed again after the exchange is completed. A simple cover may be used which can be bolted as a separate item to the outside of the container wall. Preferably, however, the cover is connected to the pull-out module and replaced together with the pull-out module. This has the advantage that the feed cables, which are required for the electrolytic treatment of the workpieces and which must be disconnected when exchanging the treatment tables and electrodes, can be connected to simple plug connectors provided on the cover on the outside of the tub, so that the feed cables connected with the treatment tables can be automatically disconnected or reconnected as the pull-out module is extracted or reinserted. The best arrangement of the plug connectors is one, where one component is mounted on the cover, or an extension of the cover, and its counterpart is located next to the access on the tub or on its support structure.

In order to be able to flood the cylinder with treatment liquid, one or several feeding pipes are required in the tub for conveying treatment liquid to the treatment tables. These feeding pipes are preferably also equipped with plug couplings, where one component is connected to the pull-out module and its counterpart is fixed to the tub, so that these feeding pipes also are automatically uncoupled when extracting the pull-out module and automatically recoupled when reinserting the pull-out module.

After inserting the pull-out module into the tub, the cover and the tub are tightened together by means of a spindle and nut arrangement, whereby the nut is preferably displaceable against a spring force, so that, when the pull-out module is inserted, the nut can escape as the spindle impacts upon the nut. Additionally, a shock absorber is provided, preferably between the tub and an extension of the cover, in order to prevent damage to the coupling components when the pull-out module is inserted into the tub and runs up against a stop.

Starting point and principle area of application of the invention is an installation for the electrolytic surface treatment of engine blocks in the region of their cylinder running areas. However, the invention can be utilized in other applications also, where surface treatment of workpieces is carried out by flooding partial surfaces by a treatment liquid.

This treatment may not necessarily be an electrolytic metal deposition process, but could be, for example, an anodic oxidation of a surface, for example, the anodic oxidation of an area of a cylindrical surface on an aluminum caliper for a disk brake.

An exemplary embodiment of the invention is shown on attached illustrations.

Figure 2:
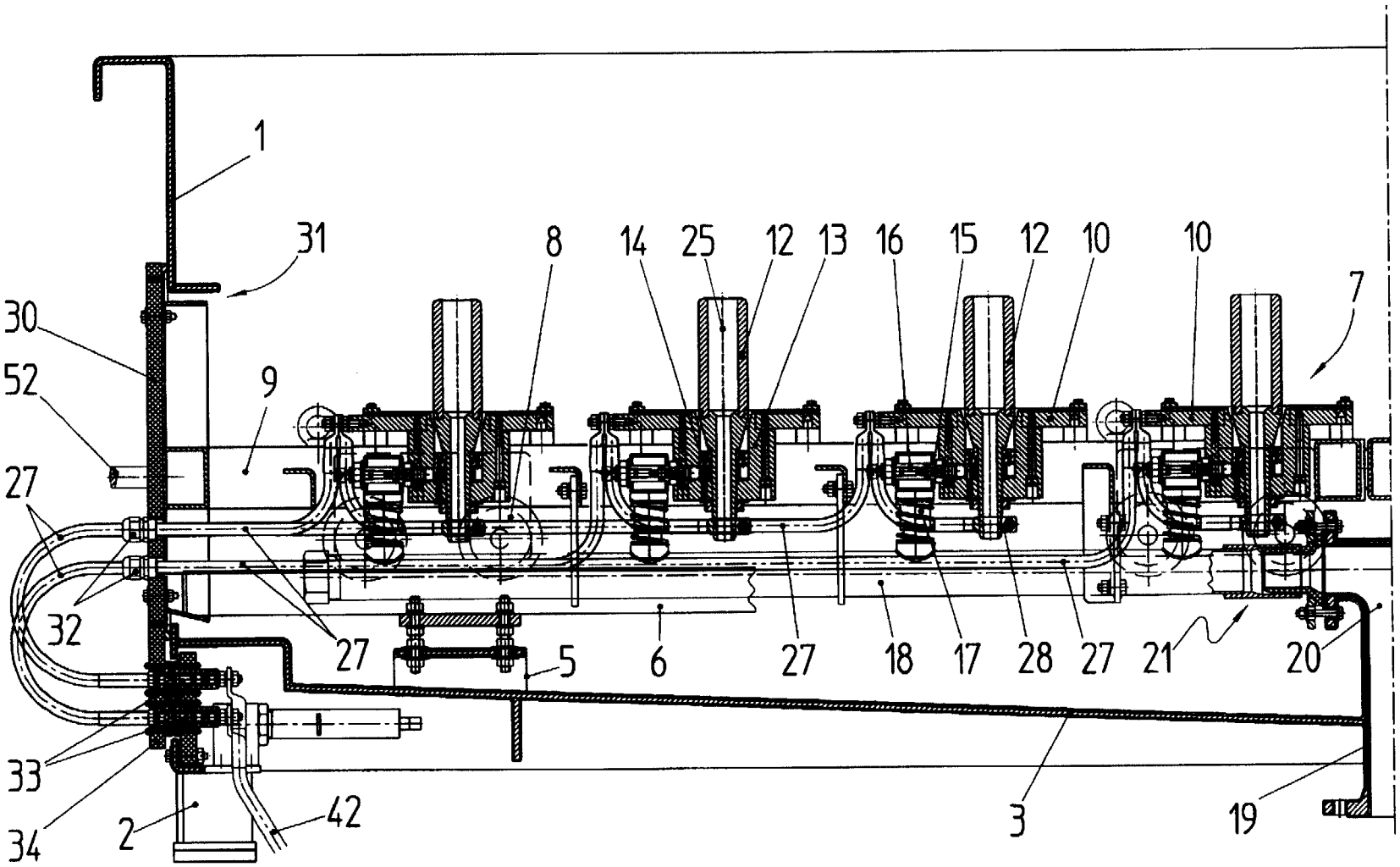
Figure 3:
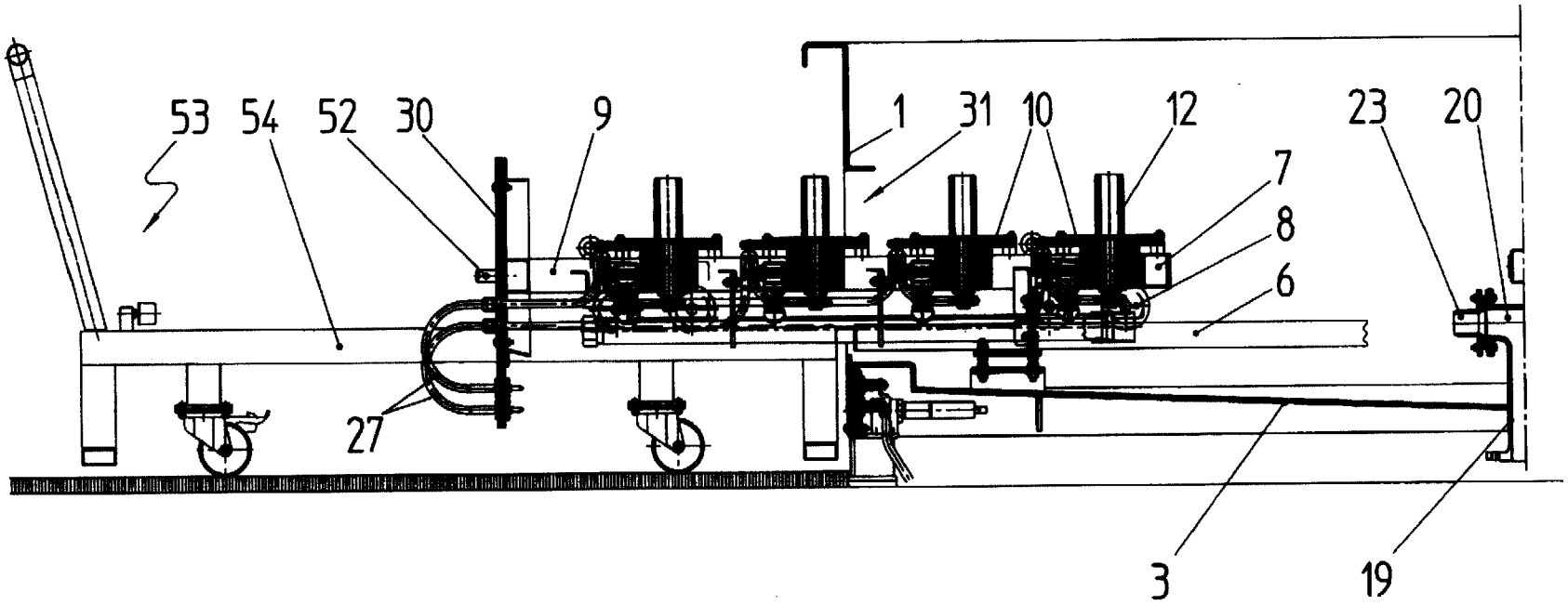
Figure 4:
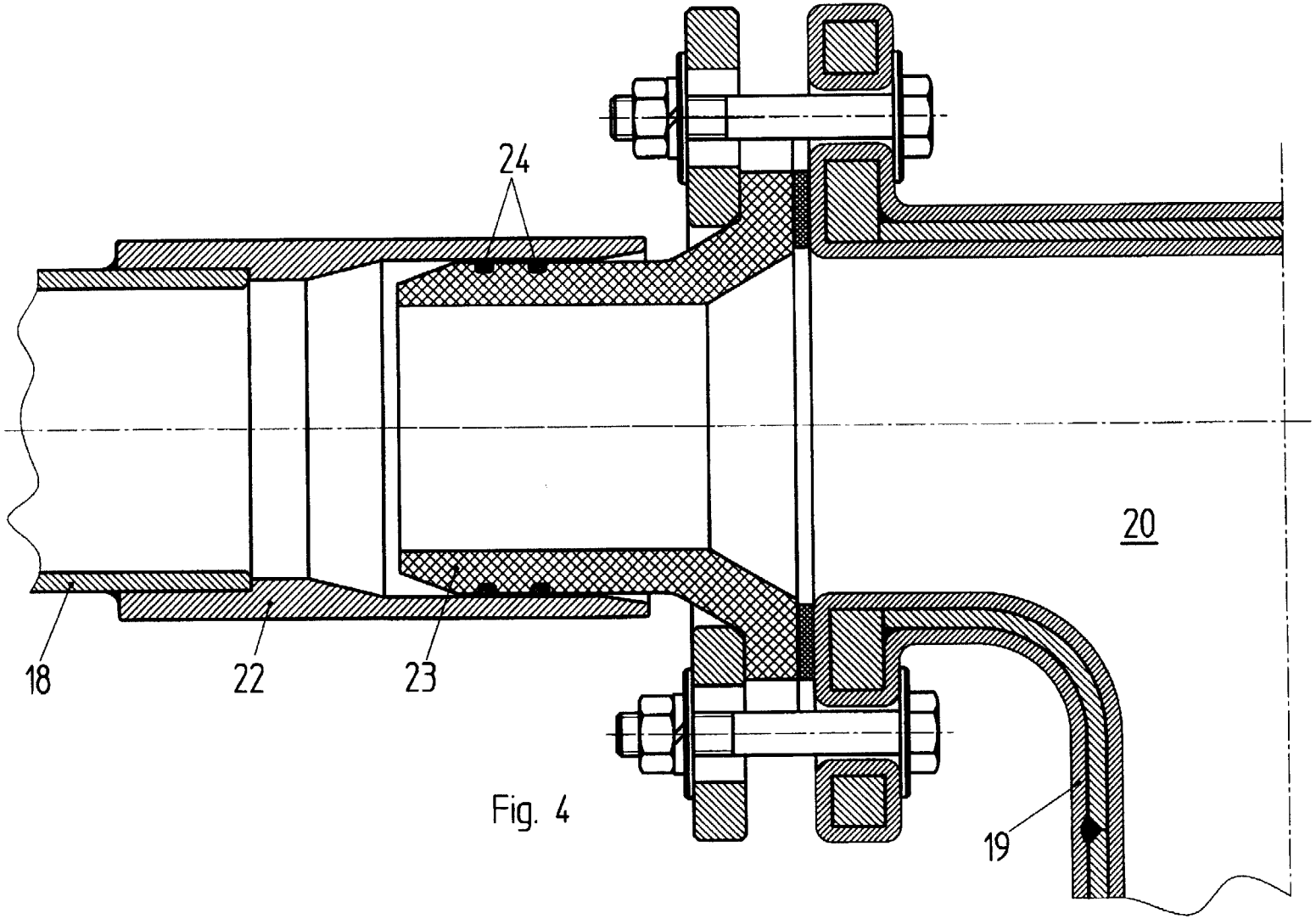
Figure 5:
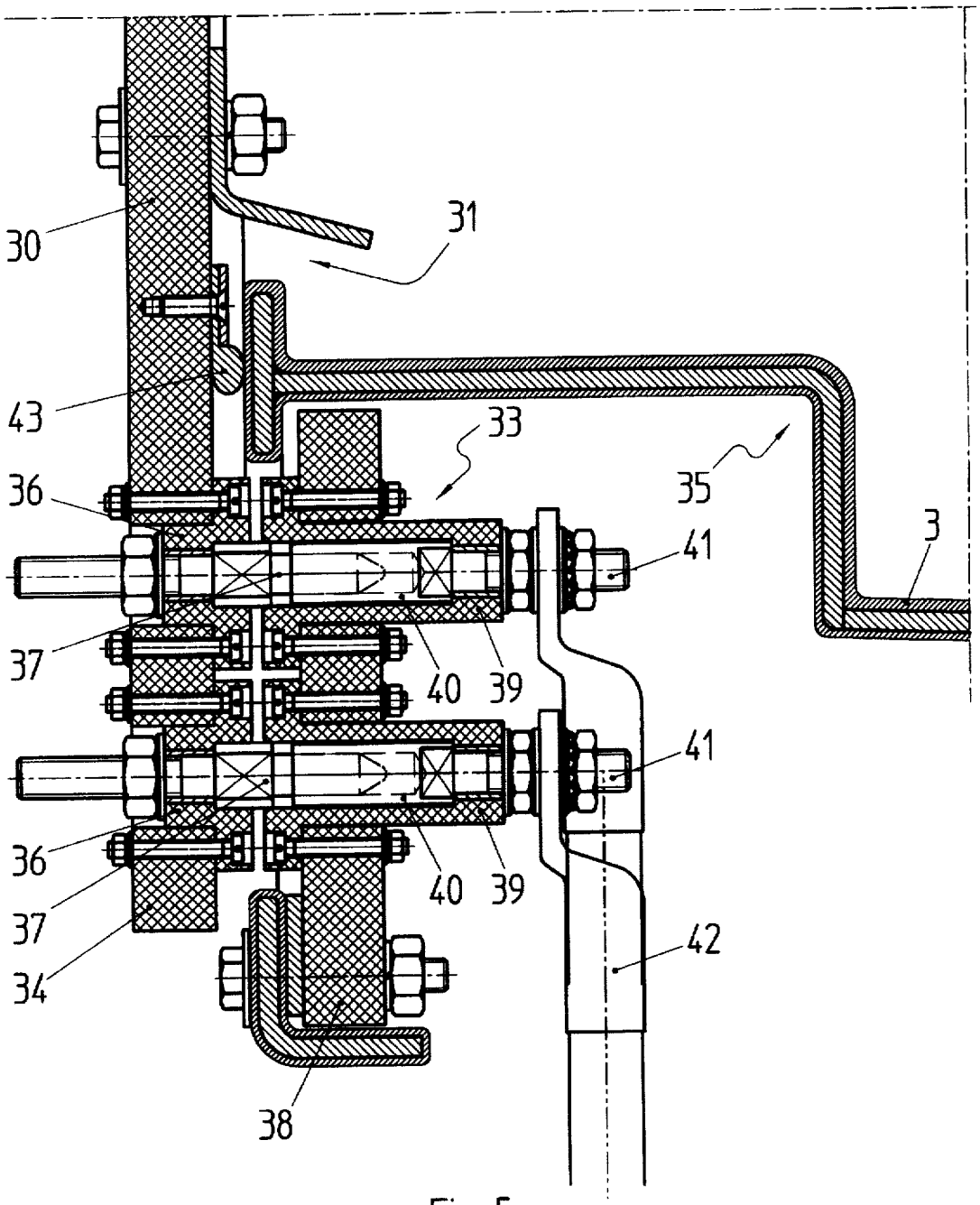
Figure 6:
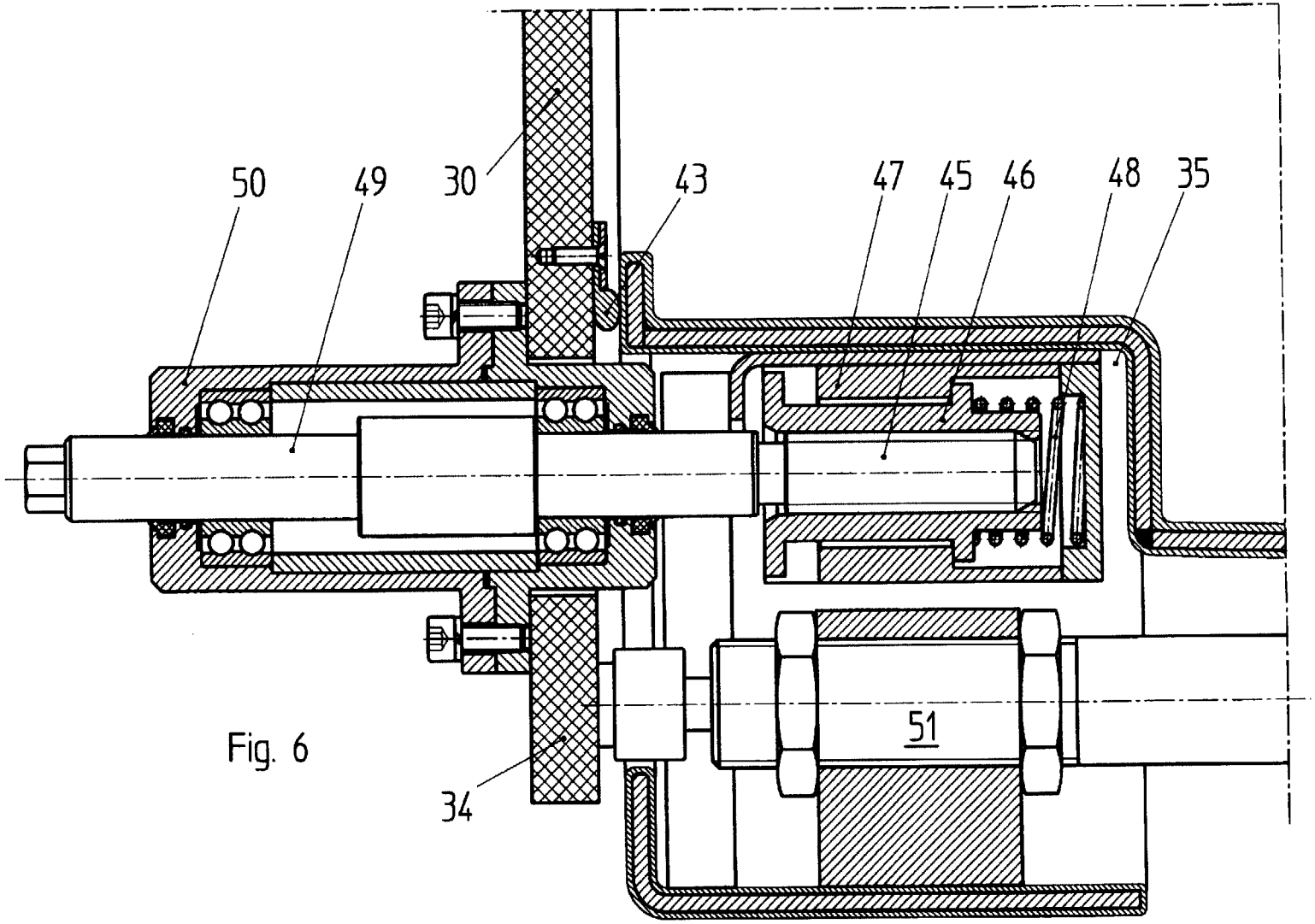

FIG. 1 shows a vertical cross-section through a device for the electrolytic coating of cylinder running surfaces of an engine block with a metal, FIG. 2 shows section II—II of the device according to FIG. 1, FIG. 3 shows the device in a representation according to FIG. 2 with partially extracted pull-out module, FIG. 4 shows, as detail, a cross-section of the embodiment of a coupling in a feeding pipe for the treatment liquid of this device, FIG. 5 shows, as detail, a vertical cross-section of the arrangement and embodiment of electric couplings for this device, and FIG. 6 shows, as detail, a vertical longitudinal cross-section of an arrangement consisting of spindle, nut, and shock absorber in the region between cover and tub of this device.

The device comprises a tub 1 which is supported on feet 2, so that the bottom 3 of the tub is a certain distance above the floor 4 on which the feet are standing. Only a quarter of the tub is shown: half of the width in FIG. 1, and half of the length in FIG. 2.

In each half of the tub 1 (see FIG. 1) two horizontal, longitudinally orientated (see FIG. 2), parallel rails 6 are fixed to pedestals 5 which are supported on the bottom 3 of the tub. On each pair of rails a pull-out module 7, designed as a frame, is provided which can be moved in longitudinal direction on rails 6 by means of wheels 8 which are mounted on the longitudinal beams 9 of the frame.

Each pull-out module supports four plates 10, arranged back-to-back on the same elevation, whose top surfaces are each covered with a rubber layer 11 upon each of which which an engine block with six cylinders can be placed. Accordingly, the pullout module is equipped with six hollow, cylindrical electrodes 12, each of which is mounted below the plate 10 on a support structure 13 in which a beaker-like cavity 14 surrounds each of the electrodes 12 forming an annulus in a section located below the surface of the plate 10. A supply pipe 15 is connected on the side of each annulus, whereby the six supply pipes assigned to one common plate 10 are fed by a common transverse feeding pipe 16 which is connected by means of a vertical, sprung connection pipe 17 to the feeding pipe 18, which runs midway between the rails 6 and is fixed to pull-out module 7. A pipe 19 is welded in the middle of the bottom 3 of the tub, from where it projects upward and is connected to a T-piece 20 which is connected to feeding line 18 by means of a plug coupling 21, shown in detail in FIG. 4. The plug coupling 21 is made up of a sleeve 22 which, on its one side, is welded to the end of feeding line 18 and, on its the other side, is slip fitted to a pipe connector 23 with two external O-rings 24 and a flange for connection to the T-piece 20.

Treatment liquid is fed into pipe 19 and distributed by means of the feeding pipe 18, pipes 17, 16 and 15 into the annuli 14, where it rises to above the upper edge of plate 10, provided that on top of plate 10 a motor block is placed into whose cylinders project electrodes 12 creating an annulus; the treatment liquid rises in the annuli created by cylinder walls and electrodes 12 until it overflows over the upper edge of the electrodes 12 and freely drains away through the vertical drain channels 25 provided inside the electrodes 12. This way the treatment liquid reaches the bottom 3 of the tub which is inclined and takes the treatment liquid to outlet connection piece 26 located at the lowest point of the tub (located in the right half of the tub which is not shown in FIG. 2).

The hollow electrodes 12 protrude downward beyond their support structure 13, where each is connected to a feed cable 27 by means of, for example, a terminal screw 28. A bundle of these feed cables 27 is passed to cover 30 which closes off an access 31 which is provided in one of the side walls of tub 1. This bundle of feed cables 27 penetrates the cover 30 by means of a number of cable penetrations 32 and terminates in electric plug connectors 33 which are arranged on a downward extension 34 of the cover and are shown in detail in FIG. 5. Behind the extension 34, bottom 3 of the tub exhibits an indentation 35 which affords room for the plug connectors 33. The plug parts of the plug connectors are arranged on the extension 34 of the cover and each consists of a plastic housing 36 which contains a plug pin 37.

A retainer plate 38, which is connected to the tub 1 and which runs parallel to cover 30, carries the socket parts of the plug connectors. The socket parts, mounted in drill holes, each consist of a plastic housing 39 containing a plug socket 40 whose back extension 41 is connected with feed cable 42 which is connected with an electric power source.

Between the cover and the edge of the access 31 to the interior of the tub, a gasket 43 runs along the edge of the access and is fastened to the cover 30 (FIG. 5).

The cover 30 is fastened to the tub 1 by means of a spindle 45 and nut 46 arrangement. The nut 46 is located in a housing 47 which is fastened to the tub 1, has limited mobility in this housing 47 and is restrained by the force of a coil spring 48. A shank 49 extending from the threaded portion of the spindle 45, can be turned and moved longitudinally between stops in a housing 50 which is fastened to the outside surface of extension 34 of cover 30. Additionally, extension 34 bears against a shock absorber 51 whose housing is rigidly connected with the tub 1.

The electrodes 12 are anodes in the case of electrolytic metal deposition, and cathodes in the case of anodic surface treatment.

The workpiece (the engine block) itself is the counter-electode. The engine block can be suspended from a beam and lowered into the tub 1 and placed on the plate 10 in a known manner, whereby simultaneously the beams can be engaged in contact forks which are arranged at the edge of the tub and are also connected with an electric power source. Providing electric contact with the workpiece by means of a workpiece support beam is state of the art and therefore not shown in the illustration.

If the pull-out module including accessories are to be replaced, the spindle 55 must first be unthreaded from the nut 46; then pull-out module 7 can be extracted on rails 6 through the now open access 31 by pulling on grip 52 (FIG. 2) which is fixed to the cover 30 which is rigidly connected with pull-out module 7. In order to pick up pullout module 7, a carriage 53 is first placed in front of access 31; the carriage 53 has a support frame with two rails 54 whose spacing and elevation correspond with spacing and elevation of rails 6. The carriage 53 is sufficiently long for picking up the entire pull-out module. The pull-out module can then be transported away with the carriage; with the same kind of carriage a different pull-out module can be transported to access 31 and inserted into the tub 1, whereby—because the pull-out module is guided on rails 6—the pipe coupling in the feeding pipe 18 (FIG. 4) and the electric plug connectors (FIG. 5) are connected automatically. The end stop of the pull-out module is cushioned by shock absorber 51, and the cover 30 is fastened to the tub 1 by threading the spindle 45 into the nut 46.

We claim:

1. Device for the selective, especially electrolytic treatment of surfaces of workpieces by flooding the workpieces with a treatment liquid, by means of a tub (1), by means of treatment tables (10) arranged exchangeably in the tub (1), for the treatment of workpieces, by means of at least one supply pipe (15-21) going into the tub (1) to the treatment tables (10), for conveying the liquid, and by means of at least one drain pipe (26) coming out of the tub (1), for conveying the liquid, characterized in that the treatment tables (10) are mounted on a pullout module (7) and that the tub (1) is equipped with a closable access (31) in one of its side walls through which the pull-out module (7), including the treatment tables (10), can be extracted from the tub (1).

2. Device according to claim 1, characterized in that a multitude of pull-out modules (7) and a corresponding number of closeable accesses (31) are provided in the tub (1).

3. Device according to claim 2, characterized in that two pull-out modules (7) are arranged back-to-back and can be extracted on opposite sides of the tub (1).

4. Device according to claim 3, characterized in that a cover (30) fixed to the pull-out module (7) is provided for closing the respective access (31).

5. Device according to claim 4, characterized in that for the electrolytic treatment of workpieces feed cables (27) pass from the cover (30) to the treatment tables (10) and that plug connectors (33) are provided on the cover (30) which connect the feed cables (27) with an electric power source.

6. Device according to claim 5, characterized in that the counterparts (39, 40) of plug connector parts (36, 37) on the cover (30) are fixed next to the access (31) to the tub (1) or to its support.

7. Device according to claim 6, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

8. Device according to claim 5, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

9. Device according to claim 5, characterized in that rails (6) are installed inside the tub (1) upon which the pull-out module (7) runs.

10. Device according to claim 4, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

11. Device according to claim 4, characterized in that rails (6) are installed inside the tub (1) upon which the pull-out module (7) runs.

12. Device according to claim 3, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

13. Device according to claim 3, characterized in that rails (6) are installed inside the tub (1) upon which the pull-out module (7) runs.

14. Device according to claim 2, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

15. Device according to claim 2, characterized in that rails (6) are installed inside the tub (1) upon which the pull-out module (7) runs.

16. Device according to claim 1, characterized in that inside the tub (1) and along the pull-out module (7) there is a feeding pipe (18) for the treatment liquid in which a plug coupling (21) is provided whose one part (22) is provided at the pull-out module (7) and whose other part (23) is fixed inside the tub (1).

17. Device according to claim 1, characterized in that rails (6) are installed inside the tub (1) upon which the pull-out module (7) runs.

18. Device according to claim 17, characterized in that outside the tub (1) a carriage (53) with rails (54) is provided, upon which the pull-out module (7) can run.

19. Device according to claim 1, characterized in that a shock absorber (51) is provided between the extension (34) of the cover (30) and the tub (1).

20. Device according to claim 1, characterized in that for tensioning together tub (1) and cover (30), a spindle (45) and nut (46) arrangement is provided, whereby the nut (46) is displaceable against a spring force.

* * * * *